US009433990B2

(12) United States Patent
Kim

(10) Patent No.: US 9,433,990 B2
(45) Date of Patent: Sep. 6, 2016

(54) CUSHION PIN DEVICE FOR PRESS

(71) Applicant: Hyundai Motor Company, Seoul (KR)

(72) Inventor: Ju Young Kim, Cheonan-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 119 days.

(21) Appl. No.: 14/220,852

(22) Filed: Mar. 20, 2014

(65) Prior Publication Data

US 2015/0059425 A1 Mar. 5, 2015

(30) Foreign Application Priority Data

Sep. 5, 2013 (KR) ..... 10-2013-0106560

(51) Int. Cl.

| | |
|---|---|
| ***B21D 24/14*** | (2006.01) |
| ***B21D 24/08*** | (2006.01) |
| *B30B 15/06* | (2006.01) |
| *B21D 24/02* | (2006.01) |

(52) U.S. Cl.

CPC ..... *B21D 24/14* (2013.01); *B21D 24/08* (2013.01); *B21D 24/02* (2013.01); *B30B 15/061* (2013.01)

(58) Field of Classification Search

CPC ..... B21D 24/02; B21D 24/04; B21D 24/08; B21D 24/10; B21D 24/14; B30B 1/32; B30B 1/34; B30B 1/38; B30B 15/061; B30B 15/0052; B30B 15/16; B30B 15/26; Y10S 100/918

USPC ..... 72/19.9, 20.2, 350, 351, 441, 453.01, 72/453.02, 453.1, 453.13, 465.1, 466.7; 267/119

See application file for complete search history.

(56) References Cited

U.S. PATENT DOCUMENTS

| | | | | |
|---|---|---|---|---|
| 5,299,444 | A * | 4/1994 | Kirii | B21D 24/14 100/259 |
| 5,687,598 | A * | 11/1997 | Kirii | B21D 24/14 72/21.5 |
| 5,735,201 | A * | 4/1998 | Hirao | B21D 24/12 100/269.01 |
| 5,979,211 | A * | 11/1999 | Pahl | B21D 24/08 72/351 |
| 6,634,205 | B2 * | 10/2003 | Yashima | B21J 9/12 100/269.06 |
| 7,764,076 | B2 * | 7/2010 | Di Stefano | G01M 1/12 324/756.01 |
| 2006/0010954 | A1 * | 1/2006 | Baba | B21D 24/02 72/351 |
| 2011/0045113 | A1 * | 2/2011 | Miyasaka | B21D 24/02 425/145 |

FOREIGN PATENT DOCUMENTS

KR 10-1247618 B1 3/2013

* cited by examiner

*Primary Examiner* — Peter DungBa Vo
*Assistant Examiner* — Joshua D Anderson
(74) *Attorney, Agent, or Firm* — Morgan, Lewis & Bockius LLP

(57) ABSTRACT

A cushion pin device for a press having a cushion pad in which a blank holder is seated on the top thereof outside a lower mold, and locks a blank holder to an upper mold while pressurizing an edge of a molded panel, includes: a cushion support disposed below the cushion pad, a cushion cylinder connected with a lower part of the cushion pad to move up or down the cushion pad from the cushion support, a linear scale mounted between the cushion pad and the cushion support to measure the position of the cushion pad, a main pressure control unit that keeps internal pressure of each cushion cylinder similarly, and a sub pressure control unit that is interconnected with the main pressure control unit so as to control the locking position of the cushion pad when each cushion cylinder operates.

6 Claims, 3 Drawing Sheets

CUSHION PIN DEVICE FOR PRESS

CROSS-REFERENCE TO RELATED APPLICATION

The present application claims priority to Korean Patent Application No. 10-2013-0106560 filed on Sep. 5, 2013, the entire contents of which is incorporated herein for all purposes by this reference.

BACKGROUND OF THE INVENTION

1. Field of the Invention

The present invention relates to a cushion pin device for a press, and more particularly, to a cushion pin device for a press that moves up and down a cushion pad on which a blank holder is seated so as to generate blanking holding force on a panel which is press-molded, controls lock holding and move-up of the cushion pad through hydraulic control, and controls a locking position degree.

2. Description of Related Art

In general, an automaker produces an automobile by assembling 20 to 30 thousand parts several times.

In particular, as a first step of an automobile manufacturing process, product panels are produced through various types of press devices and thereafter, transferred to a vehicle body factory and respective parts of product panels are assembled to form a vehicle body in a white body (B.I.W) state.

As such, in order to mold a material panel to the product panel, average four press molding processes are gone through, which are constituted by a draw molding process, a trimming and piercing molding process, a cutting and piercing molding process, and a flanging and piercing molding process, and the draw molding process as a process of firing a material according to product data is a primary process of determining 90% or more of the quality of a panel product.

In a general press device applied to the draw molding process, a lower punch having a bottom shape of the product panel is mounted on a lower bolster and a blank holder is mounted on the bolster outside the lower punch through a cushion pin device.

The conventional cushion pin device applied to the press controls a cushion cylinder connected with a cushion pad and an operating position of the cushion cylinder by controlling hydraulic pressure supplied to the cushion cylinder so as to generate blanking holding force by moving up or down the cushion pad on which a blank holder is seated.

However, in such a conventional press device, hydraulic pressure supplied to the cushion cylinders respectively disposed at both sides of the cushion pin device are maintained to be same to control the operating position of the cushion cylinder, and as a result, locking move-up and lock holding of the cushion pad are performed, but a locking position of the cushion pad cannot be controlled under a condition to produce the press with a logic valve which is just turned on/off by only a single signal, and as a result, it is difficult to cope with both a material and an item of a panel.

Further, the locking position of the logic valve should be controlled by changing an output timing of a locking signal for each item (pressure/cushion stroke) and each SPM (production speed) of the molded panel, and as a result, it is complicated to control the logic valve and when a response speed of the logic valve is changed, a distribution of the locking position of the cushion pad is generated. Therefore, the press is inactivated or a problem occurs in quality of the product panel which is press-molded.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a cushion pin device for a press that moves up and down a cushion pad on which a blank holder is seated so as to generate blanking holding force on a press-molded panel, controls lock holding and move-up of the cushion pad through a hydraulic control, and precisely controls a locking position degree to prevent a distribution of a locking position of the cushion pad from being generated and prevent inactivation of a press and a problem in quality of a product panel of which molding is completed depending on a locking position distribution.

In an aspect of the present invention, a cushion pin device for a press which may include a cushion pad in which a blank holder is seated on a top thereof outside a lower mold, and locks a blank holder to an upper mold while pressurizing an edge of a molded panel so as to generate blank holding force through the blank holder, may include a cushion support disposed below the cushion pad, cushion cylinders that are mounted on a lower part of the cushion pad to move up or down the cushion pad from the cushion support, while an operating rod thereof penetrates the cushion support on both lower sides of the cushion support, a linear scale mounted between the cushion pad and the cushion support so as to measure a position of the cushion pad which is operated by an operation of the cushion cylinders, main pressure control units, each of which keep internal pressure of each of the cushion cylinders similarly so that the each of the cushion cylinders operate simultaneously when the cushion cylinders for lock holding and locking move-up of the cushion pad operate, and a sub pressure control unit that is interconnected with the main pressure control units and cushion cylinders so as to control locking position of the cushion pad when the each of the cushion cylinders operates.

The main pressure control unit may include main logic valves, each of which is mounted on an upper side of a corresponding cushion cylinder, a main pressure conformity pipe that is mounted by connecting the main logic valves to each other and in which working fluids supplied to each of the cushion cylinders selectively flow through the main pressure conformity pipe by operation of the main logic valves respectively.

The main pressure control unit may further include relief pipes, each of which is mounted by connecting one lower side of the corresponding cushion cylinder and one side of a corresponding main logic valve so as to return remaining working fluids of the corresponding main logic valve to the corresponding cushion cylinder.

Each relief pipe returns the working fluid that flows into the corresponding main logic valve to the corresponding cushion cylinder when the working fluid that flows into the corresponding main logic valve is equal to or higher than a preset pressure while keeping each cushion cylinder at a same pressure as each other through the main pressure conformity pipe.

The sub pressure control unit may include a sub logic valve installed on the main pressure conformity pipe, and a sub pressure adjustment pipe that selectively discharges the working fluid that flows into the sub logic valve from the main pressure conformity pipe to each of the relief pipes to control a flow rate of the working fluid in the main pressure conformity pipe.

The sub pressure adjustment pipe is connected to each of the relief pipes provided in the each of the cushion cylinders at both sides of the sub logic valve.

The sub pressure control unit is operated by a measurement value measured from the linear scale.

Support cylinders that support both sides of the cushion pad which moves up from the cushion support are mounted on both lower sides of the cushion support, respectively.

In another aspect of the present invention, a cushion pin device for a press may include a cushion pad, a cushion support disposed below the cushion pad, cushion cylinders that are connected to the cushion pad to move up or down the cushion pad from the cushion support, main pressure control units, each of which keep internal pressure of each of the cushion cylinders similarly so that the each of the cushion cylinders operate simultaneously when the cushion cylinders for lock holding and locking move-up of the cushion pad operate, and a sub pressure control unit that is interconnected with the main pressure control units and cushion cylinders so as to control locking position of the cushion pad when the each of the cushion cylinders operates, and support cylinders that support both sides of the cushion pad which moves up from the cushion support are mounted on both lower sides of the cushion support, respectively.

The main pressure control unit may include main logic valves, each of which is mounted on an upper side of a corresponding cushion cylinder, a main pressure conformity pipe that is mounted by connecting the main logic valves to each other and in which working fluids supplied to the cushion cylinders selectively flow through the main pressure conformity pipe by operation of the main logic valves respectively.

The main pressure control unit may further include relief pipes, each of which is mounted by connecting one lower side of the corresponding cushion cylinder and one side of corresponding main logic valve so as to return remaining working fluids of the corresponding main logic valve to the corresponding cushion cylinder.

Each relief pipe returns the working fluid that flows into the corresponding main logic valve to corresponding cushion cylinder when the working fluid that flows into the corresponding main logic valve is equal to or higher than a preset pressure while keeping each cushion cylinder at a same pressure as each other through the main pressure conformity pipe The sub pressure control unit may include a sub logic valve installed on the main pressure conformity pipe, and a sub pressure adjustment pipe that selectively discharges the working fluid that flows into the sub logic valve from the main pressure conformity pipe to each of the relief pipes to control a flow rate of the working fluid in the main pressure conformity pipe.

The sub pressure adjustment pipe is connected to each of the relief pipes provided in the each of the cushion cylinders at both sides of the sub logic valve.

A linear scale is mounted between the cushion pad and the cushion support so as to measure a position of the cushion pad which is operated by an operation of the cushion cylinders, and the sub pressure control unit is operated by a measurement value measured from the linear scale.

In further another aspect of the present invention, a control method of a cushion pin device for a press, wherein the cushion pin device may include a cushion pad, cushion cylinders mounted on the cushion pad, main pressure control units having main logic valves, each of which is mounted on an upper side of a corresponding cushion cylinder, a main pressure conformity pipe that is mounted by connecting the main logic valves to each other, and relief pipes, each of which is mounted by connecting one lower side of the corresponding cushion cylinder and one side of corresponding main logic valve, a sub pressure control unit that is interconnected with the main pressure control units and the cushion cylinders, may include selectively supplying working fluids of the cushion cylinders to each other through the main pressure conformity pipe by operation of the main logic valves respectively, and returning through the relief pipes the working fluid that flows into the corresponding main logic valve to the corresponding cushion cylinder when the working fluid that flows into the corresponding main logic valve is equal to or higher than a preset pressure while keeping each cushion cylinder at a same pressure as each other through the main pressure conformity pipe.

The control method may further include measuring an output value of a linear scale, and operating the sub pressure control unit in accordance with a measured output value of the linear scale.

According to an exemplary embodiment of the present invention, a cushion pin device for a press moves up and down a cushion pad on which a blank holder is seated so as to generate blanking holding force on a press-molded panel, controls lock holding and move-up of the cushion pad through a hydraulic control, and precisely controls a locking position degree to prevent a distribution of a locking position of the cushion pad from being generated, and as a result, the cushion pin device for a press is commonly applied to materials and items of various panels, thereby saving facility investment cost.

Further, it is possible to prevent inactivation of a press due to the generation of the distribution of the locking position and a problem in quality of a product panel of which molding is completed by preventing the distribution of the locking position from being generated to improve productivity, and improve marketability of the product panel and enhance and the quality problem of the product panel.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
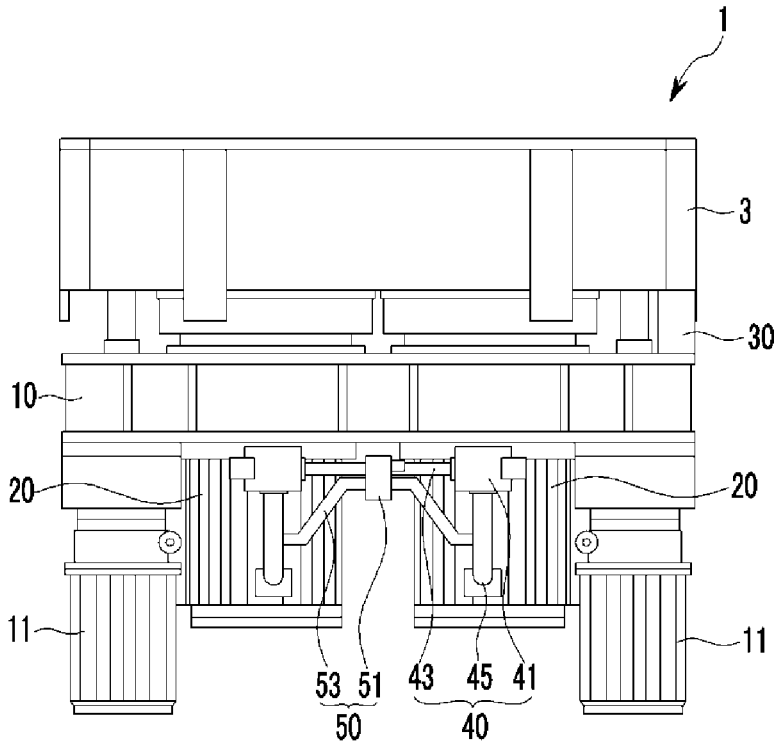
FIG. 1 is a configuration diagram of a cushion pin device for a press according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Prior to this, embodiments described in the present specification and configurations illustrated in the drawings are only the most preferred embodiment of the present invention and do not represent all of the technical spirit of the present invention, and thus it is to be understood that various equivalents and modified examples, which may replace the embodiments and the configurations, are possible when filing the present application.

In addition, in the specification, unless explicitly described to the contrary, the word "comprise" and variations such as "comprises" or "comprising", will be understood to imply the inclusion of stated elements but not the exclusion of any other elements.

In addition, the terms " . . . unit", " . . . means", " . . . part", and " . . . member" described in the specification mean units of a general configuration performing at least one function or operation.

Figure 2:
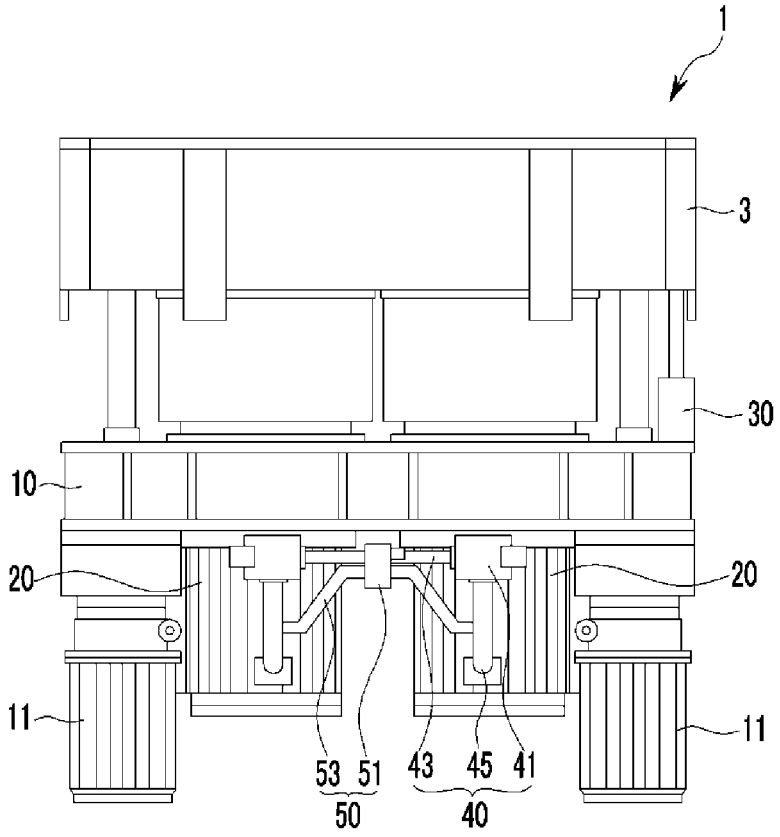
FIG. 2 is an operating state diagram of the cushion pin device for a press according to the exemplary embodiment of the present invention.
Figure 3:
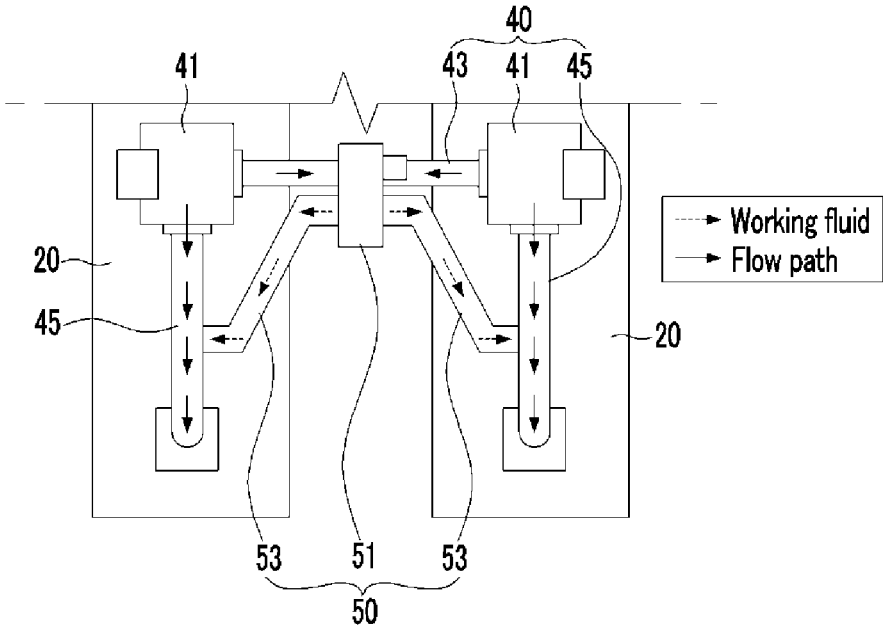
FIG. 3 is an operating state diagram of a main pressure control unit and a sub pressure control unit in the cushion pin device for a press according to the exemplary embodiment of the present invention.

FIG. 1 is a configuration diagram of a cushion pin device for a press according to an exemplary embodiment of the present invention, FIG. 2 is an operating state diagram of the cushion pin device for a press according to the exemplary embodiment of the present invention, and FIG. 3 is an operating state diagram of a main pressure control unit and a sub pressure control unit in the cushion pin device for a press according to the exemplary embodiment of the present invention.

Referring to the figures, the cushion pin device 1 for a press according to the exemplary embodiment of the present invention has a structure to move up and down a cushion pad 3 on which a blank holder is seated so as to generate blanking holding force on a press-molded panel, control lock holding and move-up of the cushion pad 3 through a hydraulic control, and precisely control a locking position degree to prevent a distribution of a locking position of the cushion pad 3 from being generated and prevent inactivation of a press and a problem in quality of a product panel of which molding is completed depending on a locking position distribution.

To this end, the cushion pin device 1 for a press according to the exemplary embodiment of the present invention basically includes the cushion pad 3 in which a blank holder is mounted on the top thereof outside a lower mold, and includes a cushion support 10, a cushion cylinder 20, a linear scale 30, a main pressure control unit 40, and a sub pressure control unit 50 so as to lock a blank holder to an upper mold while pressurizing an edge of a molded panel so as to generate blank holding force through the blank holder, as illustrated in FIG. 1.

First, the cushion support 10 is disposed below the cushion pad 3.

The cushion cylinder 20 that is connected with a lower part of the cushion pad 3 to move up or down the cushion pad 3 from the cushion support 10 is mounted on both lower sides of the cushion support 10, while an operating rod thereof penetrates the cushion support 10.

Herein, support cylinders 11 that support both sides of the cushion pad 3 which moves up from the cushion support 10 may be mounted on both lower sides of the cushion support 10, respectively.

In the exemplary embodiment, the linear scale 30 is mounted between the cushion pad 3 and the cushion support 10 so as to measure the position of the cushion pad 3 which is operated by an operation of the cushion cylinder 20.

Herein, the linear scale 30 as an encoder that measures a linear displacement is applied for positioning in a mechanic device such as the press and since this corresponds to widely known technology, hereinafter, a detailed description of a configuration and an operation thereof will be omitted.

In addition, the main pressure control unit 40 keeps internal pressure of each cushion cylinder 20 similarly so that the respective cushion cylinders 20 operate simultaneously when the cushion cylinder 20 for lock holding and locking move-up of the cushion pad 3 operates.

The main pressure control unit 40 includes a main logic valve 41, a main pressure conformity pipe 43, and a relief pipe 45.

First, the main logic valve 41 is each mounted on one upper side of each cushion cylinder 20 and is selectively opened and closed so as to constantly keep the internal pressure of the cushion cylinder 20.

The main pressure conformity pipe 43 is mounted by connecting the main logic valves 41 to each other and the internal pressure of each cushion cylinder 20 is kept similarly as working fluids supplied to the respective cushion cylinders 20 flow to each other by opening and closing each main logic valve 41.

In the exemplary embodiment, the relief pipe 45 is mounted by connecting one lower side of each cushion cylinder 20 and one side of each main logic valve 41 to each other.

Each relief pipe 45 returns the working fluid that flows into the main logic valve 41 to each cushion cylinder 20 when the working fluid that flows into the main logic valve 41 is equal to or higher than set pressure while keeping each cushion cylinder 20 at the same pressure as each other through the main pressure conformity pipe 43.

That is, the main pressure control unit 40 configured as above keeps the internal pressures of both cushion cylinders 20 to be the same through the pressure conformity pipe 43 by operating the main logic valve 41 while the cushion pad 3 moves up to a set locking position when the cushion cylinder 20 is operated by working pressure supplied to the cushion cylinder 20 to move up the cushion pad 3, as illustrated in FIG. 2.

Thereafter, the main logic valve 41 controls the lock holding and the locking move-up in the state where the cushion pad 3 moves up by returning the working pressure to the inside of the cushion cylinder 20 through the relief pipe 45 again so as to prevent the cushion pad 3 from moving up to a set height or higher.

In addition, the sub pressure control unit 50 is interconnected with the main pressure control unit 40 so as to control the locking position of the cushion pad 3 when each cushion cylinder 20 operates.

Herein, the sub pressure control unit 50 may include a sub logic valve 51 installed on the main pressure conformity pipe 43 and a sub pressure adjustment pipe 53 that selectively discharges the working fluid that flows into the sub logic valve 51 from the main pressure conformity pipe 43 to each relief pipe 45 to control a flow rate of the working fluid in the main pressure conformity pipe 43.

In the exemplary embodiment, the sub pressure adjustment pipe 53 may be connected to each of the relief pipes 45 provided in each cushion cylinder 20 at both sides of the sub logic valve 51.

The sub pressure control unit 50 may be operated by a measurement value measured from the linear scale 30.

That is, the sub pressure control unit 50 configured as above selectively discharges the working fluid on the main pressure conformity pipe 43 to each relief pipe 45 through the sub pressure adjustment pipe 53 to control the locking position of the cushion pad 3 which moves up when the sub logic valve 51 is selectively operated according to an output value output from the linear scale 30, as illustrated in FIG. 3.

As a result, the cushion pin device 1 enables the locking move-up and the lock holding, and minute adjustment of the locking position of the cushion pad 3 regardless of materials and items of panels molded in different shapes for each vehicle type through the main pressure control unit 40 and the sub pressure control unit 50 to prevent the distribution of the locking position of the cushion pad from being generated.

Accordingly, according to the exemplary embodiment of the present invention configured as above, when the cushion pin device 1 is applied, the cushion pin device 1 for a press moves up and down the cushion pad 3 on which the blank holder is seated so as to generate the blanking holding force on the press-molded panel, controls lock holding and move-up of the cushion pad 3 through a hydraulic control, and precisely controls the locking position degree to prevent the distribution of the locking position of the cushion pad 3 from being generated, and as a result, the cushion pin device for a press is commonly applied to materials and items of various panels, thereby saving facility investment cost.

Further, the cushion pin device 1 prevents inactivation of a press due to the generation of the distribution of the locking position and a problem in quality of a product panel of which molding is completed by preventing the distribution of the locking position from being generated to improve productivity, and improve marketability of the product panel and enhance the quality problem of the product panel.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. They are not intended to be exhaustive or to limit the invention to the precise forms disclosed, and obviously many modifications and variations are possible in light of the above teachings as well as various alternatives and modifications thereof. It is intended that the scope of the invention be defined by the Claims appended hereto and their equivalents.

What is claimed is:

1. A cushion pin device for a press which includes a cushion pad in which a blank holder is seated on a top thereof outside a lower mold, and locks a blank holder to an upper mold while pressurizing an edge of a molded panel so as to generate blank holding force through the blank holder, the device comprising:

a cushion support disposed below the cushion pad;

cushion cylinders mounted on a lower part of the cushion pad to move up or down the cushion pad from the cushion support, while an operating rod thereof penetrates the cushion support on both lower sides of the cushion support;

a linear scale mounted between the cushion pad and the cushion support so as to measure a position of the cushion pad which is operated by an operation of the cushion cylinders;

main pressure control units, each of which is configured to keep internal pressure of each cushion cylinder of the cushion cylinders similarly so that the each cushion cylinder of the cushion cylinders operate simultaneously when the cushion cylinders for lock holding and locking move-up of the cushion pad operate; and a sub pressure control unit interconnected with the main pressure control units and cushion cylinders so as to control locking position of the cushion pad when the each cushion cylinder of the cushion cylinders operates, wherein the main pressure control unit includes:

main logic valves, each of which is mounted on an upper side of a corresponding cushion cylinder;

a main pressure conformity pipe that is mounted by connecting the main logic valves to each other and in which working fluids supplied to the each cushion cylinder of the cushion cylinders selectively flow through the main pressure conformity pipe by operation of the main logic valves respectively, and wherein the sub pressure control unit includes:

a sub logic valve installed on the main pressure conformity pipe, wherein the sub logic valve is separately installed from the main logic valves; and a sub pressure adjustment pipe separately installed from the main pressure conformity pipe and configured to selectively discharge the working fluid flowing into the sub logic valve from the main pressure conformity pipe to relief pipes to control a flow rate of the working fluid in the main pressure conformity pipe.

2. The device of claim 1, wherein each relief pipe of the relief pipes is mounted by connecting one lower side of the corresponding cushion cylinder and one side of a corresponding main logic valve so as to return remaining working fluids of the corresponding main logic valve to the corresponding cushion cylinder.

3. The device of claim 2, wherein the each relief pipe is configured to return the working fluid that flows into the corresponding main logic valve to the corresponding cushion cylinder when the working fluid that flows into the corresponding main logic valve is equal to or higher than a preset pressure while keeping each cushion cylinder at a same pressure as each other through the main pressure conformity pipe.

4. The device of claim 1, wherein the sub pressure adjustment pipe is connected to the each relief pipe of the relief pipes provided in the each cushion cylinder of the cushion cylinders at both sides of the sub logic valve.

5. The device of claim 1, wherein the sub pressure control unit is operated by a measurement value measured from the linear scale.

6. The device of claim 1, wherein support cylinders that support both sides of the cushion pad which moves up from the cushion support are mounted on both lower sides of the cushion support, respectively.

* * * * *